US007329158B1

(12) United States Patent
Roberts et al.

(10) Patent No.: US 7,329,158 B1
(45) Date of Patent: Feb. 12, 2008

(54) PUSH-LOCK TERMINAL CONNECTION ASSEMBLY

(75) Inventors: James Dickinson Roberts, Royal Oak, MI (US); Joseph Paul Kalisz, Plymouth, MI (US); James Leroy Jones, III, Bellville, MI (US); Kevin James Updike, Canton, MI (US); Weizhen Brenda Wang, Ann Arbor, MI (US)

(73) Assignee: Yazaki North America, Inc., Canton, MI (US)

( * ) Notice: Subject to any disclaimer, the term of this patent is extended or adjusted under 35 U.S.C. 154(b) by 7 days.

(21) Appl. No.: 11/477,353

(22) Filed: Jun. 30, 2006

(51) Int. Cl.
*H01R 11/22* (2006.01)

(52) U.S. Cl. ..... 439/851; 439/825; 439/848

(58) Field of Classification Search ..... 439/851, 439/748, 853, 852, 744, 593, 849, 848, 825, 439/835

See application file for complete search history.

(56) References Cited

U.S. PATENT DOCUMENTS 3,644,872 A * 2/1972 Russo, Jr. ..... 439/849
4,550,963 A * 11/1985 Moors ..... 439/170
4,552,425 A * 11/1985 Billman ..... 439/295
4,764,133 A * 8/1988 Kaneko ..... 439/889
5,401,185 A * 3/1995 Wang et al. ..... 439/441
6,264,509 B1 7/2001 Kwang et al.
6,293,833 B1 9/2001 Kamath
6,544,079 B2 * 4/2003 Renkes et al. ..... 439/848
6,804,122 B1 10/2004 Wong et al.
6,932,659 B1 8/2005 Wong
7,033,194 B1 4/2006 Le Beau

FOREIGN PATENT DOCUMENTS

GB 2189090 A * 10/1987

* cited by examiner

*Primary Examiner*—Tho D. Ta
*Assistant Examiner*—Travis Chambers
(74) *Attorney, Agent, or Firm*—Daniel R. Edelbrock

(57) ABSTRACT

A male terminal has spring elements bent back from a rounded end above a flat portion of the terminal and separated by a centrally located opening. An aperture extends through the flat portion under the opening. Elongated ridges protrude from an underside of the flat portion. A female terminal has arms overhanging a base to form receptacles for the spring elements. Down-turned alignment ribs on the arms are received in the opening in the male terminal to properly align the terminals during electrical connection. Dimples protrude from the arms to contact the spring elements of the male terminal as the spring elements are inserted. The elongated ridges on the underside of the flat portion of the male terminal contact the base of the female terminal. A lock tab in the base between the ribs snaps into the aperture to latch the terminals together when the spring elements are fully inserted.

20 Claims, 5 Drawing Sheets

PUSH-LOCK TERMINAL CONNECTION ASSEMBLY

BACKGROUND OF THE INVENTION

1. Field of the Invention

The invention relates in general to the connection of electrical terminals and more particularly to high power terminals that are interlocked by pushing one terminal in a sliding motion into another terminal.

2. Discussion of Related Art

A power distribution center or module (PDM) consolidates fuses, branch circuits, relays, connectors and other electrical components in a single location within a vehicle. The PDM often includes a mounting surface having a plurality of receptacles for receiving the electrical components. A bus bar is routed beneath the surface and has a plurality of blade-like projections that protrude into some or all of the receptacles to make electrical contact with the components. The bus bar is used to supply electrical power to the components for serving the vehicle electrical circuit requirements. The electrical power is usually provided to the bus bar through a high power cable from the vehicle alternator and/or battery.

Typically, in high power connections, an eyelet terminal is crimped on the end of the high current cable. The eyelet terminal fits over a threaded stud extending through the bus bar in the PDM, and a nut is used to tighten the eyelet terminal into electrical connection with the bus bar. Alternatively, a separate bolt and nut could be used to secure the terminal to the bus bar. Either way, retention features of these types increase labor costs because they require tools, often with torque monitoring capabilities, to fasten the terminal to the bus bar. This provides the opportunities for cross-threading or improperly torqued attachments that could cause loose connections. Inadequately tightened connections in turn could lead to electrical arcing, overheating, loss of contact and other undesirable events.

Co-pending, commonly-owned U.S. patent application Ser. No. 11/377,542, filed Mar. 17, 2006, now U.S. Pat. No. 7,160,157, discloses one way of eliminating the need for threaded studs, bolts and nuts to make such electrical connections. A terminal connection system has first and second terminals that interlock. The first terminal is placed on the second terminal and rotated until spring elements on the first terminal flex and slide under overhanging ledges on the second terminal. Co-pending, commonly-owned U.S. patent application Ser. No. 11/386,723, filed Mar. 23, 2006, now U.S. Pat. No. 7,134,893, sets forth a second way of eliminating additional fasteners. A first terminal has a contact section with parallel deflectable arms on each side. A second terminal has an initial seating section and a retaining section. The contact section of the first terminal is placed on the initial seating section of the second terminal and then pulled into the retaining section where the arms interlock with complementary features on the retaining section. No threaded fasteners or tools are required in either of these inventions.

However, in some environments, such as those using self-docking type connectors, it is required to have terminals that mate by a simply pushing them together. Though push-to seat terminals are known in the art, they are often difficult to align for correct electrical mating and require relatively high insertion forces so they maintain reliable electrical connection.

SUMMARY OF THE INVENTION

Accordingly, it is an object of this invention to allow connection of high power terminals without the use of fastening devices, manual or power tools, or other added mechanisms.

Another object of the invention is to enable the terminals to interlock and provide a required electrical contact force simply by pushing one terminal in a sliding motion into and against another terminal.

A further object of the invention is to reliably achieve and maintain good electrical connection with integral features of the terminals.

In carrying out this invention in the illustrative embodiment thereof, a male terminal for connection to an electrical cable has a rounded mating end. The mating end is created by bending or folding the terminal back over itself, forming a straight or flat portion under a bent or folded over portion joined together at the mated end. The bent or folded over portion provides the male terminal with a fully supported cantilevered beam. A slot in the folded over portion forms spaced spring elements linked by a bridge segment opposite the mating end of the terminal. The flat portion has an aperture through it under the slot and an underside with elongated, protruding bumps or ridges aligned beneath the spring elements.

A female terminal has a base formed on the end of a bus bar for a power distribution module or other electrical device. The base has two opposite sides. An arm extends from each side. Each arm has a segment that overhangs the base and a longitudinal rib or alignment segment extending toward the base from an inner periphery of the overhang segment. A small bump or dimple on an underside of each overhang segment faces the base within a chamber formed by each arm. A resilient lock tab protrudes upward from the base between the ribs.

To make the electrical connection, the ribs on the female terminal are aligned with the slot in the male terminal and the spring elements are forced under the overhang segments of the arms until the lock tab snaps into the aperture. The spring elements are biased into contact with the arms. The dimples on the underside of the overhang segments, through contact with the spring elements, provide an inertial mate assist with vibration dampening to yield a reliable electrical connection. The elongated ridges on the underside of the flat portion of the male terminal are pressed against the base of the female terminal by the spring elements to provide electrical contact. To separate the terminals, the lock tab is pressed downward out of the aperture and the male terminal is then pulled away from the female terminal.

The dimples and ridges provide multiple contacts between the terminals, supplying a higher surface conductivity for the same general volume of terminal. The need for a stud on the power distribution module side is eliminated. The assembly allows connection of high power terminals (for automotive battery and ground applications) without the use of fastening devices such as bolts and nuts and manual or power assembly tools. This design allows a cable-side terminal to be directly mated into a component-side receiving terminal in a push-to seat action with a positive, integral lock to secure the terminals together. The assembler gets positive visual, audible and tactile feedback. This operation can be performed single-handed and reduces the overall labor time for this type of connection. Therefore, there are system and labor cost-savings and increased electrical connection reliability.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
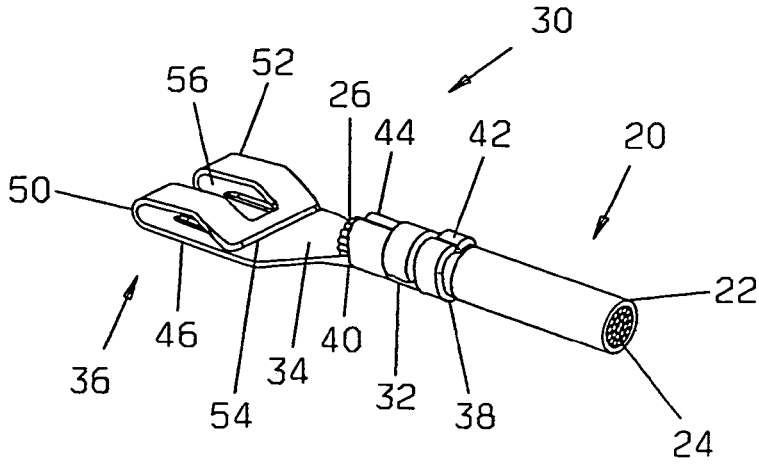
FIG. 1 is an isometric view of a first or cable-side terminal of a connector or electrical connection assembly according to the present invention.
Figure 2:
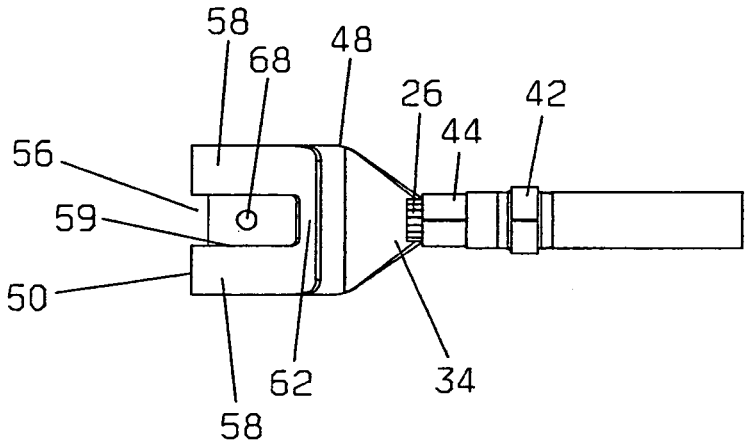
FIG. 2 is a top view of the cable-side terminal.
Figure 3:
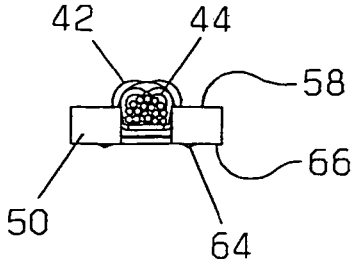
FIG. 3 is an end view of the cable-side terminal from the insertion or mating end.

Referring now to FIGS. 1-5, a first, male, cable-side terminal of an electrical connection system or assembly according to the present invention is illustrated. The first terminal is designed for attachment to a high power wire harness or electrical cable 20. The cable depicted is used as an example and includes an outer insulation jacket 22 surrounding multiple inner conductors 24. The inner conductors 24 are exposed at a stripped end 26 of the cable.

The first, male, cable-side terminal 30 has a first, wire-connect section 32, and a second, intermediate or stem section 34 slightly angled from the wire-connect section and joining the wire-connect section to a third, contact section 36. The wire-connect section 32 has an end 38 distal from the stem section 34 and an opposite end 40 joining the wire-connect section to the stem section. The end 38 has tabs 42 for crimping around the insulation jacket 22 of the cable 20 to physically secure the terminal to the cable. Additional tabs 44 between the tabs 42 and the opposite end 40 of the wire-connect section are used for crimping around the exposed conductors 24 of the cable to electrically connect the terminal to the cable. The stem section 34 increases in width as it approaches a juncture with the contact section 36.

Figure 4:
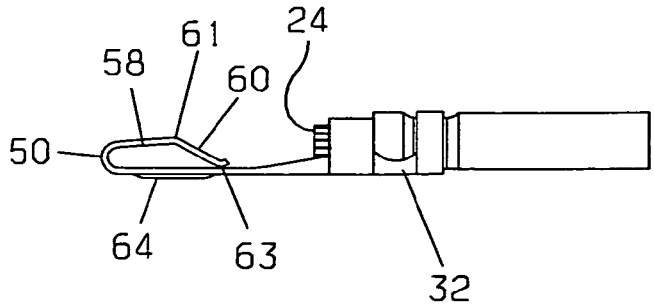
FIG. 4 is a side view of the cable-side terminal.

The contact section 36 has a substantially straight or flat portion 46 with a first end 48 integrally joined with the stem section 34 and a second end 50 distal from the stem section. The second end 50 is a curved or rounded leading surface and is formed by bending or folding a portion 52 of the contact section 36 back over itself toward the stem section 34. The bent or folded over portion 52 is deflectable and has an up-turned back edge 54 above and adjacent to the first end 48 of the contact section 36. Portion 52 is therefore a fully supported cantilevered beam. The portion 52 further includes an elongated, centrally located slot or opening 56 extending between the curved end 50 of the contact section 36 to a location short of the up-turned back edge 54. The slot or opening 56 has a rectangular shape as viewed from the top (FIG. 2) and divides the folded over portion 52 into two, spaced spring elements 58 with facing inner edges 59. The spring elements 58 are slightly inclined, as best shown in FIG. 4, as they extend back from the curved end 50 over the flat portion 46. The spring elements 58 then have a decline or downward ramp 60 from a peak or apex 61 to a bridge segment 62 that links or connects the elements. The bridge segment 62 is curved such that it does not quite touch the flat portion 46 at its lowest point 63 and then elevates the up-turned back edge 54.

Figure 5:
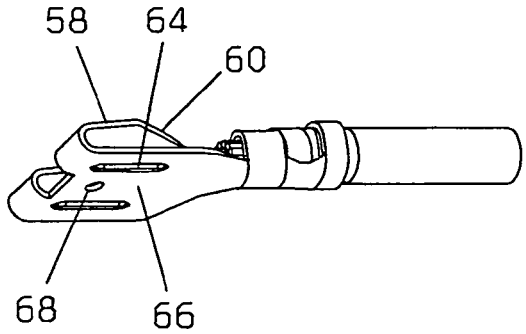
FIG. 5 is an isometric underside view of the cable-side terminal.
Figure 6:
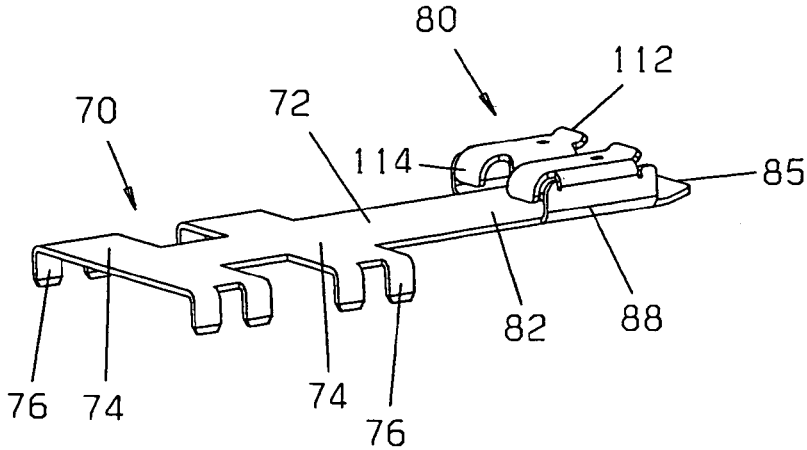
FIG. 6 is an isometric view of a bus bar and second or bus-side terminal of the connector or electrical connection assembly according to the present invention, looking along the terminal from the bus bar.
Figure 7:
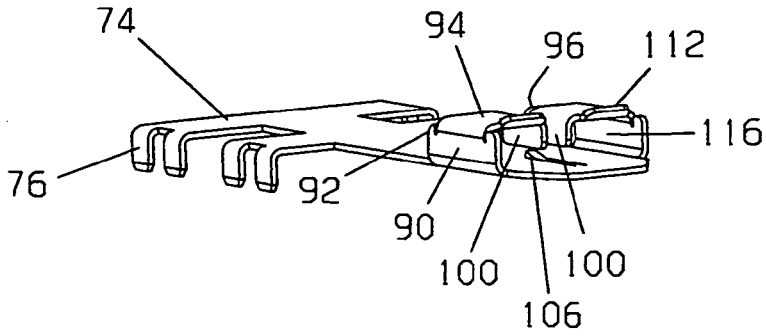
FIG. 7 is an isometric view of the bus bar and bus-side terminal from a front or mating end perspective.
Figure 8:
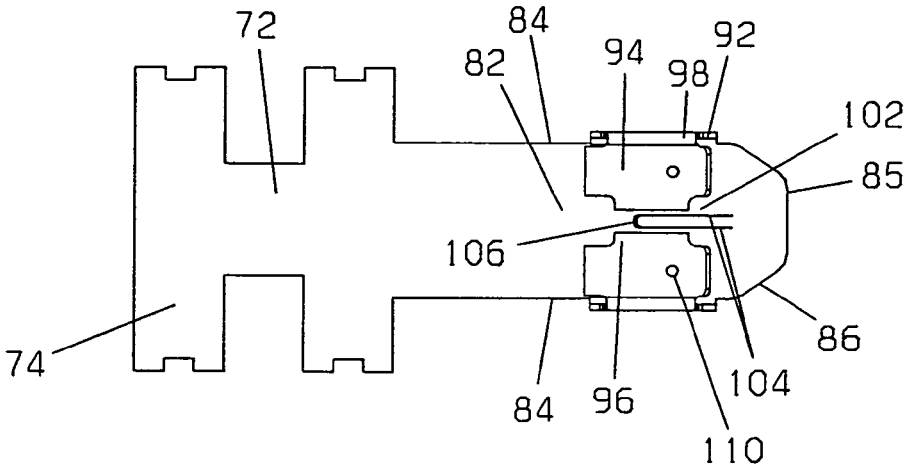
FIG. 8 is a top view of the bus bar and bus-side terminal.
Figure 9:
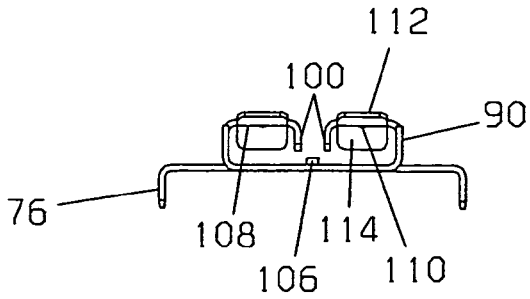
FIG. 9 is an end view of the bus bar and bus-side terminal from the mating end of the terminal.

Elongated bumps or ridges 64, best depicted in FIG. 5, are pressed or formed in the flat portion 46 parallel to and aligned under each spring element 58 to protrude from an underside 66 of the flat portion 46. The ridges 64 would appear as long, narrow indentations in a surface of the flat portion 46 facing the spring elements 58. There is also a centrally located and specifically positioned aperture 68 through the flat portion 46 under the opening 56 and between the ridges 64.

A second, female terminal of the electrical connection system is illustrated in FIGS. 6-10. This terminal is a device-side or bus-side terminal. For purposes of example, it is illustrated as being formed on the end of a lead-frame or bus bar 70 that could extend from within a power distribution center or module (PDM) or other electrical appliance or device. When used with a PDM, for example, the bus bar 70 would distribute power to various electrical circuits served by the PDM. The bus bar has a main part 72 and two branching parts 74. The branching parts 74 have outer extremities with down-turned, right-angle ends forming blades or prongs 76.

Figure 10:
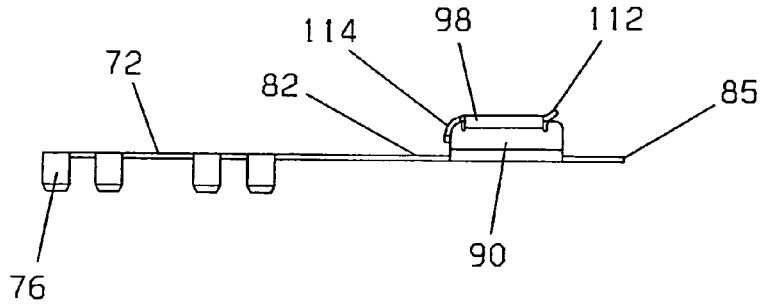
FIG. 10 is a side view of the bus bar and bus-side terminal.

The second, female terminal 80 extends from the main part 72 of the bus bar 70 as a substantially flat, widened base 82. The base 82 has two opposite sides 84 extending to a free end 85 distal from the bus bar. The free end 85 is narrowed in width by converging edges 86 of the sides 84. Two relatively wide arms 88 extend from the sides 84 prior to where the edges 86 begin to converge. Each arm 88 has a first, side wall segment 90 bent to extend generally perpendicular from base 82 and having a top edge 92 distal from the base. A second, overhang segment 94 extends from the top edge 92 substantially perpendicular to the side wall segment 90 and over the base 82 to a rounded or curved inner periphery 96. A curved outer periphery 98 of the overhang segment is slightly cut into the top edge 92 of the side wall segment 90, as best illustrated in FIG. 10, to enable the radiuses of the curved surfaces to be properly formed. A third, rib or alignment segment 100 is curved downward from the inner periphery 96 of the overhang segment 94 toward the base at a substantially right angle.

The rib segments 100 of each arm 88 are parallel to and spaced from each other across a central area 102 of the base and extend along a longitudinal axis of the terminal 80 over the base 82 without contacting the base. Two longitudinal slits 104 extend along the central area 102 of the base 82 and join to form a resilient, up-turned, protruding, deflectable lock feature or tab 106 in the base between the alignment segments 100, as perhaps best shown in FIG. 7.

The overhang segments 94 each have an underside 108 facing toward the base 82. A small, semi-spherical protrusion or dimple 110 is pressed or formed in each overhang segment to protrude or project from the underside adjacent a front extremity 112 of the overhang segment. The dimples 110 would appear as indentations in the top surfaces of overhang segments 94. The front extremity 112 is bent or raised in an upward direction away from the base. A rear or back extremity 114 of the overhang segment is curved downward toward the base. Each side wall segment 90, overhang segment 94, rear extremity 114 of the overhang segment, and rib or alignment segment 100 together form a receptacle or chamber 116 sized for receiving a spring element 58 of the male terminal 30. The raised front extremities 112 extend above entrances to the chambers 116 facing toward the free end 85 of the base 82.

Figure 11:
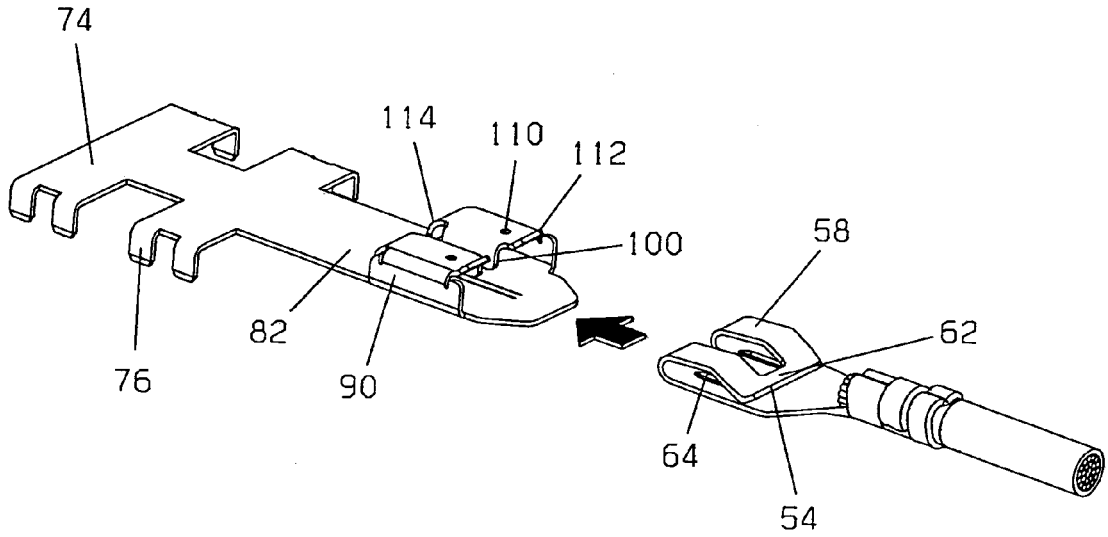
FIG. 11 is an exploded isometric view of the cable-side terminal and bus-side terminal aligned prior to assembly.

To make the electrical connection, the first terminal 30 is aligned with and pushed into the second terminal 80, as suggested by FIG. 11. The spring elements 58 deflect or flex toward the flat portion 46 of the first terminal as the rounded end surface 50 enters the chambers 116 of the second terminal. The raised front extremities 112 of the overhang segments 94 do not interfere with the insertion, enabling smooth operation. The ridges 64 on the underside 66 of the flat portion 46 slide along the base 82 as the ribs or alignment segments 100 enter the opening 56 and are guided along the inner edges 59. Simultaneously, the flat portion 46 deflects or forces the protruding lock tab 106 into the base 82 until it snaps back up and into the aperture 68 in the flat portion, locking the terminals together. This happens generally simultaneously with the abutment of the rounded end surface 50 of the first terminal against the rear extremities 114 of the arms 88 on the second terminal.

Figure 12:
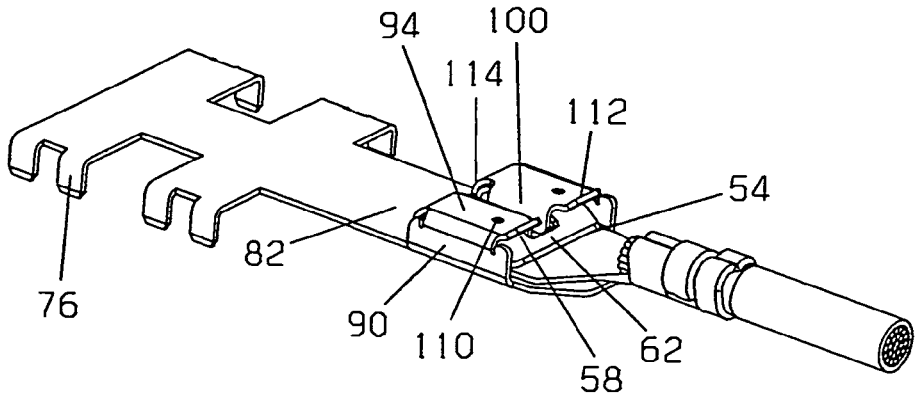
FIG. 12 is an isometric view of the terminals in a locked arrangement.

The fully-mated, locked condition of terminals is illustrated in FIG. 12. As this fully-mated or full insertion condition is approached, the dimples 110 pass the apexes 61 of the spring elements 58 and slide down the ramps 60 to pull the first terminal in further with an inertial assist. The tab 106 is the primary lock. By remaining pressed against the ramps 60, the dimples 110 further limit the possible range of movement of the contact section 36 of the first terminal, so back and forth vibration is reduced. The described shape and bias of the spring elements 58 keeps them biased against the arms, creating a frictional contact force.

To separate the terminals, the lock tab 106 is forced downward by a narrow tool and out of the aperture 68. The first terminal is then simply pulled away from the second terminal.

The connection of the terminals in this manner provides visual, audible and tactile feedback to the assembler. There are four independent mating surfaces, provided by the two semi-spherical dimples on the overhang segments of the arms and the two elongated ridges on the underside of the flat portion of the contact section. The contact points provided by these dimples and ridges cause higher normal forces and lower the contact resistance, resulting in a lower voltage drop. The alignment or indexing feature provided by the down-turned ribs forces the first terminal to be aligned and inserted correctly. It is difficult to push the first terminal into the second terminal at an angle, and the first terminal can't be pushed in upside down in an improper mating connection wherein the terminals would not interlock. As described, the sliding contact between the dimples and the ramps provide an inertial mate assist feature and also acts as a vibration damper.

In some PDM assemblies, the connectors on the cable ends are held in a frame into which a PDM is pushed for a self-docking electrical connection. The first and second terminals of the invention are illustrated as being manually connected, but the terminal design allows it to be used as a self-docking connection system. The second, female terminal extending from the bus bar of the PDM could be down-turned to mate with the first, male terminal when the PDM is pushed into the frame. The locking feature could be eliminated in this environment. Also, such terminal connections often require an insulator such as a plastic housing with mechanical locks. The current design might in some cases require an insulator, but mechanical locks are not needed. The spring element function is on the male-type, first terminal. If the spring element wears out or does not function properly, the male terminal can be easily replaced. The whole bus bar would have to be removed from the PDM and replaced if the spring element was on the female side, as is more conventional. Such a replacement operation would be difficult and time consuming. It some cases it would be less expensive to replace the PDM. The terminals can be easily separated for service.

The connection operation can be performed single-handed and reduces overall labor time and cost. The terminals can be formed relatively easily. They could be stamped, cut, and bent or otherwise manufactured from a copper alloy or brass in stock of at least 0.8 mm thickness, for example, and then tin-plated. The second terminal can be formed on an extension of the bus bar that might otherwise be removed as scrap. The terminals can be stamped for substantially the same tooling and material cost as a conventional eyelet terminal, and replace the eyelet terminal, stud and nut. The terminal connection system according to the present invention provides an assembly or connector that could be used in various environments, such as with vehicle starters, alternators, motors or actuators with lead-frames, battery terminals and grounding connections. The second terminal could be used with another wire harness for a cable-to-cable connection.

Figure 13:
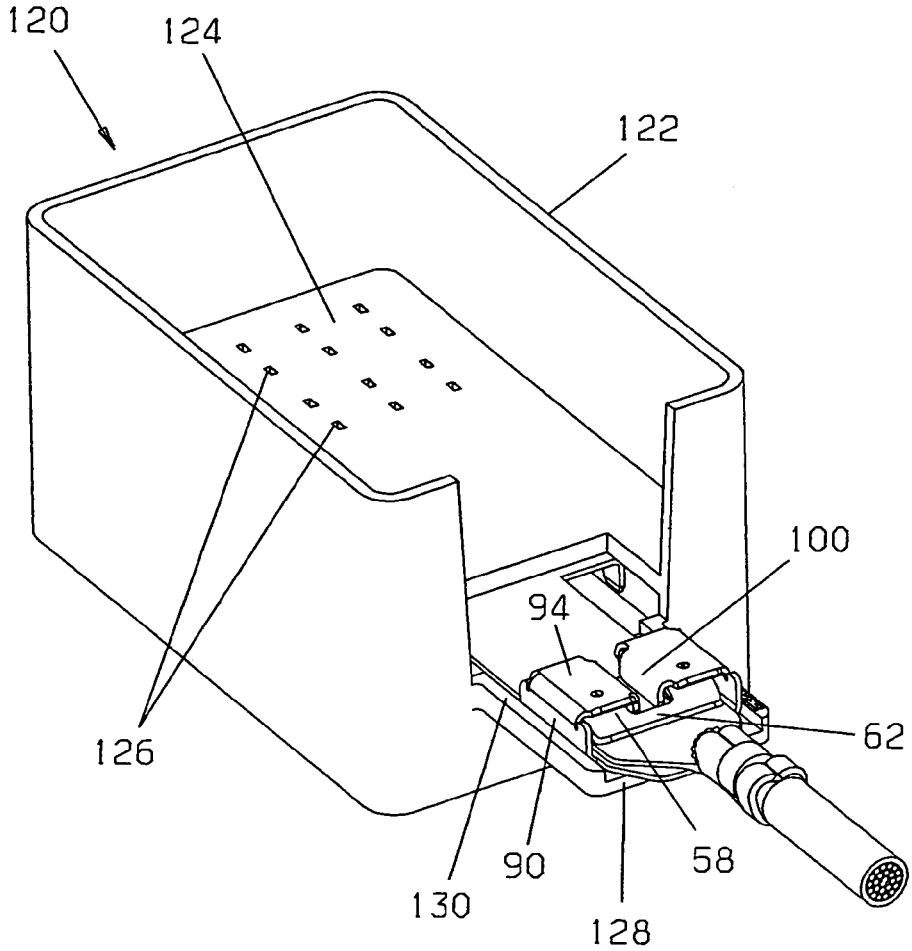
FIG. 13 is a perspective view of the terminals as used with a power distribution module.

As an example, FIG. 13 illustrates the terminal connection system as used with a PDM 120. The PDM has an outer housing 122 surrounding a horizontal mounting surface 124 for electrical components (not shown) such as relays and fuses. Receptacles 126 in the mounting surface 124 guide contacts from the electrical components into electrical connection with the prongs 76 of the bus bar under the mounting surface. An integral plate or platform 128 extends outward from the housing 122 for supporting the terminal connection. The platform has outer rails 130 that add structural stability, prevent significant side-to-side movement of the bus-side terminal, and help insulate the connection. If required, the assembled terminals can be covered and protected by a non-conductive cap tethered to the PDM, or by an extended part of a conventional PDM cover.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. An electrical connector comprising:

a first terminal having spring elements bent back from a rounded leading surface, the spring elements each having an inner edge, the inner edges facing each other and being spaced apart by a slot extending between the spring elements; and a second terminal having receptacles sized and positioned to receive each spring element of the first terminal, the receptacles each having an alignment segment, the alignment segments being spaced from each other and arranged to enter the slot against the inner edges of the spring elements to guide the spring elements into the receptacles when the first and second terminals are assembled together.

2. The connector of claim 1 wherein the spring elements extend over a substantially flat portion of the first terminal and have ramps declining toward the flat portion away from the leading surface.

3. The connector of claim 2 further comprising protrusions projecting from the receptacles in positions to contact the spring elements when the spring elements are received in the receptacles.

4. The connector of claim 3 wherein the protrusions are positioned on undersides of overhang segments of the receptacles in locations causing the protrusions to slide down the ramps as the spring elements approach a full-insertion condition within the receptacles.

5. The connector of claim 1 wherein the spring elements extend over a substantially flat portion of the first terminal, the flat portion having an underside with ridges for contacting a base of the second terminal supporting the receptacles.

6. The connector of claim 5 further comprising a resilient lock tab on the base of the second terminal and an aperture in the flat portion of the first terminal for receiving the lock tab when the spring elements are fully inserted in the receptacles.

7. An electrical terminal connection assembly comprising:

a first terminal having a substantially flat portion and an integral, deflectable portion folded back over the flat portion to provide a rounded surface at a mating end of the terminal, the first terminal also having an opening through the rounded surface and extending longitudinally along the deflectable portion; and a second terminal having a base and two arms arranged above and across a width of the base to receive the deflectable portion of the first terminal between the arms and the base, the arms each having an inner periphery and a longitudinal rib projecting toward the base from the inner periphery, the ribs being spaced from each other across an area of the base and positioned so the ribs fit into the opening of the first terminal and properly align the terminals as the terminals are pushed together and electrically mated.

8. The assembly of claim 7 further comprising an aperture through the flat portion under the opening.

9. The assembly of claim 7 wherein the second terminal is formed on a bus bar extending from an electrical device.

10. The assembly of claim 7 further comprising a releasable lock tab between the ribs for receipt in an aperture in the flat portion of the first terminal under the opening when the terminals are fully mated.

11. The assembly of claim 7 wherein the opening divides the deflectable portion into two spring elements with facing inner edges for sliding contact with the ribs, each of the inner edges contacting one of the ribs.

12. The assembly of claim 11 further comprising an elongated, protruding ridge formed in an underside of the flat portion beneath each spring element and positioned to contact the base of the second terminal as the terminals are mated.

13. The assembly of claim 11 wherein the spring elements each have a slight incline from the rounded surface relative to the flat portion.

14. The assembly of claim 13 wherein the spring elements each have a ramp declining toward the flat portion from an apex of the incline and away from the rounded surface to a bridge segment that connects the spring elements.

15. The assembly of claim 14 wherein the bridge segment curves away from the flat portion to form an up-turned back edge on the deflectable portion of the first terminal opposite the mating end.

16. The assembly of claim 7 wherein the arms of the second terminal each have side walls extending perpendicularly from the base and overhang segments extending over the base and joining the ribs to the side walls.

17. The assembly of claim 16 wherein the overhang segments have rear extremities bent downward so the rounded surface of the mating end of the first terminal abuts against the rear extremities as a full insertion condition of the deflectable portion of the first terminal is reached.

18. The assembly of claim 17 wherein the overhang segments have raised front extremities positioned to prevent interference of the overhang segments with receipt of the deflectable portion between the arms and the base.

19. The assembly of claim 16 further comprising a dimple in each overhang segment protruding toward the base to contact the deflectable portion of the first terminal.

20. The assembly of claim 19 wherein the dimples are located near a front extremity of the overhang segments.

* * * * *